US006836901B2

(12) United States Patent
Hippensteel

(10) Patent No.: US 6,836,901 B2
(45) Date of Patent: Jan. 4, 2005

(54) MULTI-USE STRIPS FOR WEARABLE ARTICLES

(76) Inventor: Joseph B. Hippensteel, 1109 S. Plaza Way #314, Flagstaff, AZ (US) 86001

( * ) Notice: Subject to any disclaimer, the term of this patent is extended or adjusted under 35 U.S.C. 154(b) by 0 days.

(21) Appl. No.: 10/159,764

(22) Filed: May 29, 2002

(65) Prior Publication Data

US 2003/0221236 A1 Dec. 4, 2003

(51) Int. Cl.[7] ..... A41D 27/16
(52) U.S. Cl. ..... 2/60; 2/54
(58) Field of Search ..... 2/46, 53, 54, 55, 2/56, 57, 58, 60, 129, 171, 181; 128/878, 881, 882; 602/18, 20, 26, 27, 62

(56) References Cited

U.S. PATENT DOCUMENTS 3,727,237 A * 4/1973 Glatt ..... 2/56
3,885,247 A * 5/1975 Kost ..... 2/55
4,097,943 A 7/1978 O'Connell
4,464,797 A * 8/1984 Glassman ..... 2/209.13
4,545,080 A 10/1985 Gorham
4,653,119 A * 3/1987 Kaiser ..... 2/60
4,678,465 A 7/1987 Avejic
4,747,162 A * 5/1988 Yanagihara ..... 2/53
4,833,734 A 5/1989 Der Estephanian
5,042,088 A 8/1991 Sherrod et al.
5,317,761 A * 6/1994 Piche ..... 2/181
5,432,955 A * 7/1995 Plotka et al. ..... 2/181
5,433,994 A * 7/1995 McKinney et al. ..... 442/221
5,553,326 A * 9/1996 Moore ..... 2/181
5,940,882 A * 8/1999 Auguste ..... 2/60
6,138,280 A 10/2000 Bae
6,178,557 B1 1/2001 Bel Monte
6,199,213 B1 3/2001 Whang
6,293,934 B1 9/2001 Kumasaka
6,341,377 B1 * 1/2002 Faries et al. ..... 2/53
6,362,391 B1 3/2002 Mizutani et al.
6,378,224 B1 4/2002 Oualkinbush et al.
6,477,715 B2 * 11/2002 Shin ..... 2/181.4

* cited by examiner

*Primary Examiner*—Gary L. Welch
(74) *Attorney, Agent, or Firm*—Alston & Bird LLP

(57) ABSTRACT

Multi-use strips can be applied to a variety of articles to absorb perspiration and protect wearable articles. The strips generally comprise a liquid permeable outer sheet, an absorbent medium, and a backsheet. Applied to the backsheet can be a fastening adhesive. A peel sheet can be attached to the backsheet that can be removed immediately prior to attaching the strip on a article. Other embodiments include attaching multi-use strip to a Velcro strip. In addition, embodiments include the distribution of a roll of material that can be cut to a desired length or provided in pre-cut stacks of the absorbent strips.

31 Claims, 3 Drawing Sheets

TOP VIEW

SIDE VIEW

SIDE VIEW

TOP VIEW

SIDE VIEW

MULTI-USE STRIPS FOR WEARABLE ARTICLES

TECHNICAL FIELD

This invention relates generally to the field of moisture absorbing and protective articles, and more particularly to relatively low cost, removable multi-use strips.

BACKGROUND ART

A wide variety of goods have been utilized to protect the cleanliness of articles of clothing, to absorb perspiration, and particularly to prevent perspiration from running into the eyes of an individual. Bandanas, sweatbands, stain shields, shoe odor neutralizers, and hand towels all currently exist for this purpose. While these devices fulfill their respective particularized objectives, none of these articles provide the versatility, convenience, and multi-use functionality. For example, some of the afore-mentioned commodities, such as a towel, are not passive and require the active use of one's hands to wipe off perspiration. Many of the other articles can only be utilized in particular locations. For example, a head sweatband is generally only conveniently worn on the head and may interfere with wearing a cap or other head covering. Stain shields work well under the arm pits, but typically are too large and unsightly to be used for absorbing perspiration on the forehead. Therefore, a disposable, low cost apparatus for clothing protection and absorbing perspiration is needed that may be used effectively in a variety of applications.

DISCLOSURE OF THE INVENTION

The present invention is a relatively low cost solution for moisture absorption and preservation of cleanliness of an article of clothing. In accordance with the invention, adhesive strips can be applied to a variety of articles. In one embodiment, the strips can be rectangular, measuring approximately one-quarter to two inches in width and approximately three to eight inches in length. These strips can comprise a liquid permeable outer sheet, an absorbent medium, and a backsheet. A fastening adhesive can be applied to the backsheet. A peel sheet can be attached to the backsheet that can be removed immediately prior to attaching the strip on an article. In another embodiment, a fibrous layer of the strip's fastener can attach to a hook fastener strip. The strip can be used for absorbing perspiration produced by the head when applied to a head covering device. Likewise, a layered strip can be applied to an article of clothing, sports equipment, footwear, and numerous other articles. In addition, embodiments include an absorbent roll of material that can be cut to a desired length or provided in pre-cut stacks of the perspiration absorbent strips.

BRIEF DESCRIPTION OF THE DRAWINGS

Benefits and further features of the present invention will be apparent from a detailed description of the preferred embodiment thereof taken in conjunction with the following drawings, wherein like elements are referred to with like reference numbers, and wherein.

DETAILED DESCRIPTION OF EMBODIMENTS

Details of multi-use absorbing strips according to the present invention will be more filly understood from the description of the disposable perspiration absorbing unit as provided hereunder with reference to the accompanying drawings.

Figure 1A:
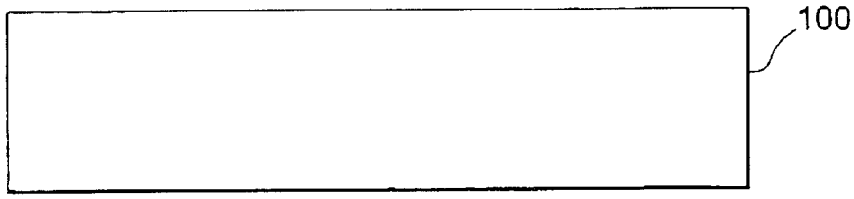
FIGS. 1A–1C is a set of diagrams depicting a strip, which includes FIG. 1A that depicts a top view, FIG. 1B that depicts a multi-layered side view, and FIG. 1C that depicts a single layer side view.
Figure 1B:
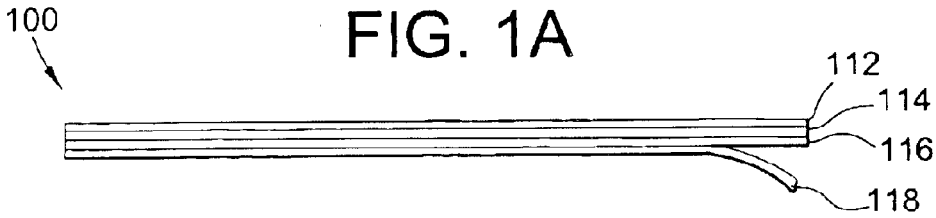

Referring to FIG. 1A, illustrated is a strip 100 in accordance with an embodiment of the invention. As illustrated, the strip 100 can be a rectangular shaped multi-layered unit. Typically, the strip is approximately one-quarter to two inches in width. In the embodiment of FIG. 1A, the absorbent strips 100 are generally used in three to eight inch lengths. The strip 100 can be made from known materials such as those used in absorbent pads or stain shields like those materials used in absorbent pads sold commercially under the federally registered KOTEX brand. As illustrated in FIG. 1B, commercially available absorbent articles typically are formed in layers. The outer layer 112 that makes contact with perspiring skin is generally composed of woven fabric such as cotton. The outer layer 112 wicks the perspiration onto the absorbing layer 114. The absorbing layer 114 can be formed of known natural or synthetic highly absorbent fabric. A backsheet layer 116 can be made from moisture impervious material such as plastic. The backside of backsheet layer 116 typically has adhesive applied to allow for easy attachment to a variety of articles. A peel away layer 118 is attached to the adhesive of the structural layer 116. The peel away layer 118 is easily removable in a known manner from the other layers 112–116 of the absorbent strip 100. Alternatively, the strip 100 can be sewed onto an article of clothing for fastening.

Figure 1C:
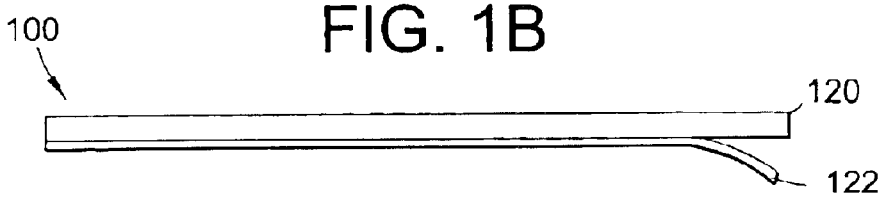

FIG. 1C depicts another embodiment wherein the strip is made from a single layer 120 from known materials such as synthetic moisture absorbent materials, polyester, cotton, and other materials. An adhesive can be applied to the single layer 120 to allow for easy attachment to a variety of articles. A peel away layer 122 can be attached to the adhesive. The peel layer 122 is easily removable in a known manner from the 100. Alternatively, the strip 100 can be sewed onto an article of clothing for fastening.

Figure 2A:
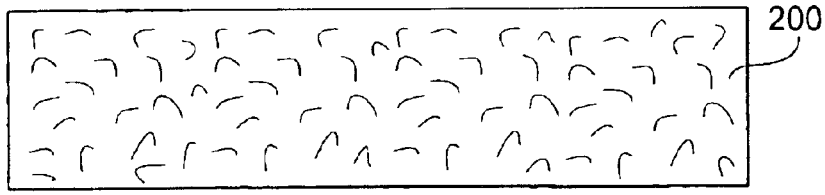
FIG. 2A is a diagram of a hooked Velcro strip.
Figure 2B:
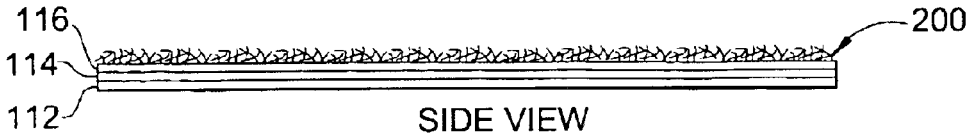
FIG. 2B is a diagram of a fibrous Velcro strip.

In an embodiment of the invention, a fibrous layer made from known materials that can easily loop onto commercial available VELCRO hook strips 200 such as those provided by Velcro Industries B.V. is attached to the adhesive applied to the backside of the backsheet layer 116. A Velcro hook strip is illustrated in reference to FIG. 2A. These hook strips 200 are commercially available in a variety of sizes and can be cut to the desired shape, if needed. The hook strips 200 generally have adhesive fastener to allow for easy attachment to a variety of articles by pressing such backings against the articles. In another embodiment, the hook strip 200 can be sewed into place on the article.

Figure 3:
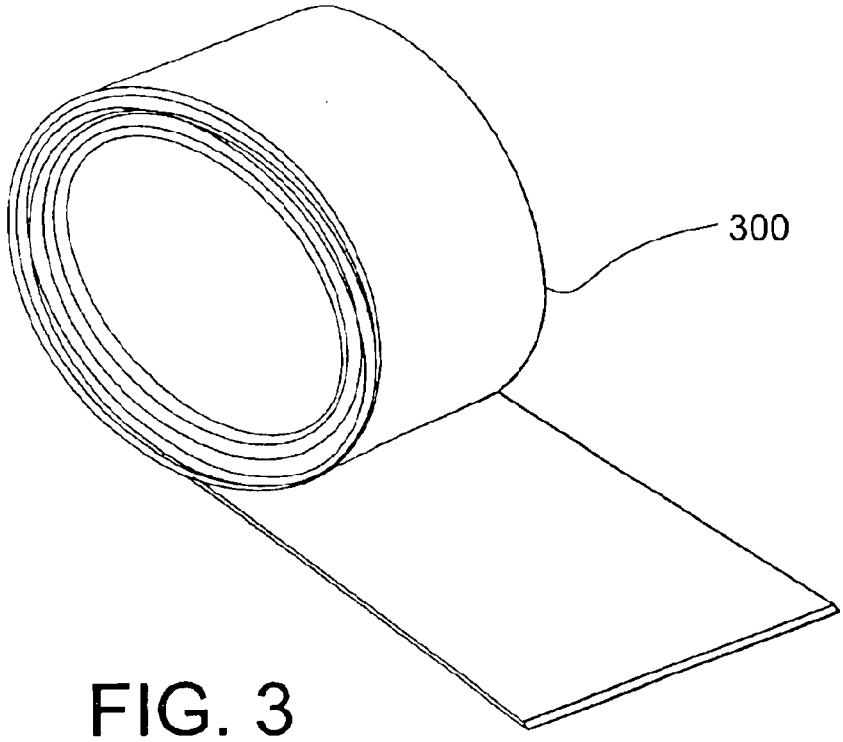
FIG. 3 is a diagram depicting a multi-use strip roll.
Figure 4:
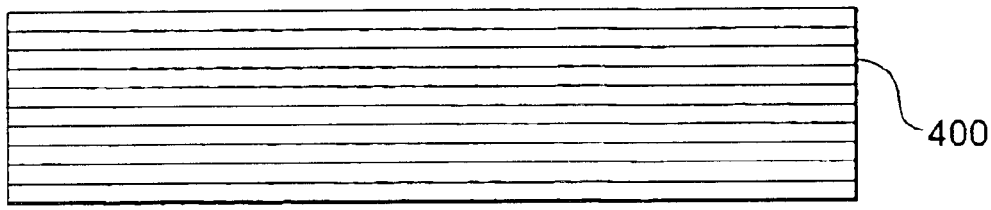
FIG. 4 is a diagram depicting a multi-use strip stack.

Turning to FIG. 3, illustrated is a multi-use absorbent unit roll 300. The roll 300 comprises a strip from one-quarter to two inches in width. The roll 300 can be sold in a wide range of lengths, such as lengths of one to twenty feet. In this form, the user can cut the length of material desired, and thus increase the potential variety of applications and decreasing wastage of the article. In addition, as illustrated in reference to FIG. 4, multi-use absorbent strips 100 can be pre-cut into standardized lengths, packaged and sold as a multi-use absorbent strip stack 400. Such stacks 400 can range widely in the number of strips included, but preferably range from ten to hundreds of strips 100.

Figure 5:
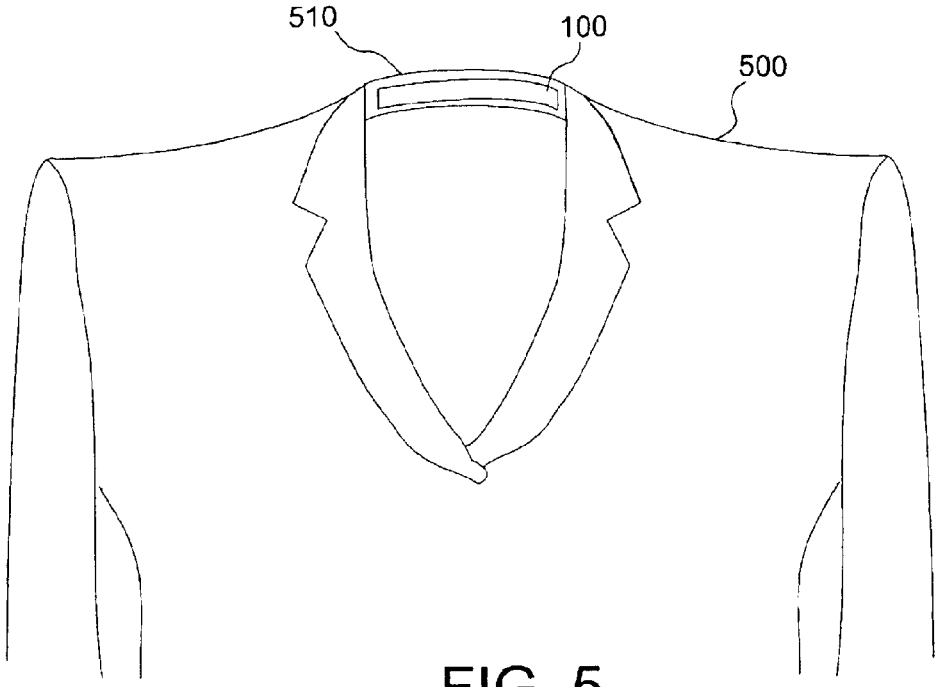
FIG. 5 is a diagram depicting a function of a multi-use strip as a perspiration absorbing collar strip.
Figure 6:
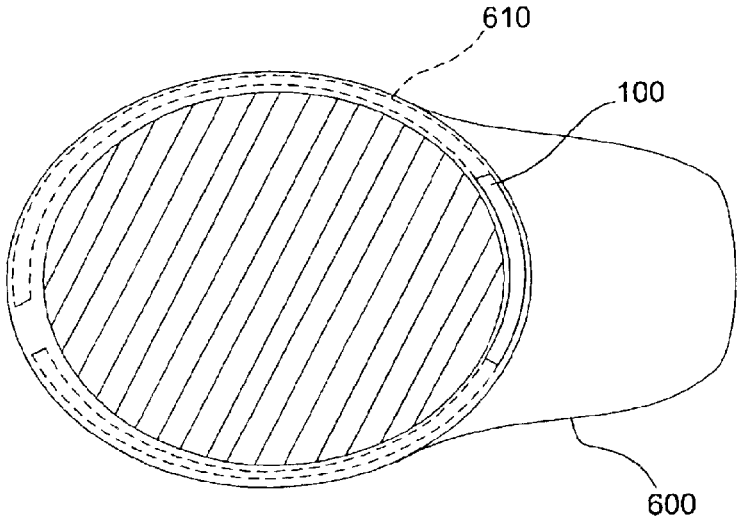
FIG. 6 is a diagram depicting a function of a multi-use strip as a perspiration absorbing head covering device strip.

Turning to FIG. 5 and FIG. 6, illustrated are some uses of a multi-absorbent strip 100. As illustrated, an absorbent strip 100 can be attached to the neck lining 510 of a shirt, blouse or similar apparel 500. After removing the peel away layer 118, the fastening adhesive backing allows for ready placement on a variety of articles by pressing the backing against such articles. The strip absorbs perspiration, which protects the garment and increases the wearer's comfort. The absorbent strip 100 can easily be removed from the apparel 500 for washing and a new strip 100 attached for the next wearing. These strips 100 can also be easily attached to outer garments in order to protect articles of clothing from dirt, oil or other stains. As shown in reference to FIG. 6, the absorbent strip 100 can be attached to the rim 610 of a cap, hat, baseball helmet or similar device 600. In this manner, perspiration can be absorbed, and can prevent perspiration from entering into one's eyes, for example. As previously indicated, the multi-use absorbent strips 100 have numerous other applications. For example, the strips 100 can be used on a shirt in the arm pit region, as an insert in shoes, under the elastic of sports bras, inside sports equipment such as helmets, knee pads, and the like, or other locations to protect from stains. Thus, the multi-use strips 100 have a range of applications that other moisture absorbing articles hereto known cannot achieve.

In view of the foregoing, it will be appreciated that the invention provides for a new and improved multi-use absorbent strip. It should be understood that the foregoing relates only to the exemplary embodiments of the present invention, and that numerous changes may be made therein without departing from the spirit and scope of the invention as defined by the following claims. Accordingly, it is the claims set forth below, and not merely the foregoing illustration, which are intended to define the exclusive rights of the invention.

The invention claimed is:

1. An absorbent article, comprising:

a layered strip with a width dimension in the range of approximately one-quarter to at most two inches and a length dimension in the range of approximately three to eight inches, the layered strip having:

an absorbent medium for absorbing moisture;

a moisture impervious backsheet having a first side attached to the absorbent medium and a second side provided with a fastener, for attaching the strip to a wearable item; and a liquid permeable outer sheet having a first side attached to the absorbent medium and a second side making contact with a human body wearing the item, said outer sheet composed of woven fabric to wick moisture from the human body to the absorbent medium.

2. The article of claim 1, wherein the layered strip further has a peel sheet attached to the backsheet.

3. The article of claim 1, wherein the layered strip is applied to a head covering device.

4. The article of claim 1, wherein the layered strip is applied to an article of clothing.

5. The article of claim 1, wherein the layered strip is applied to an article of sports equipment.

6. The article of claim 1, wherein said fastener is comprised of a fibrous material that can attach to a hook fastener strip.

7. The article of claim 1, wherein the layered strip is rectangular in shape.

8. A absorbent article, comprising:

a roll of perspiration absorbing layered material with a width dimension in the range of approximately one-quarter to at most two inches and a length dimension in the range of approximately one to twenty feet, wherein the layered material contains:

an absorbent medium for absorbing perspiration;

a moisture impervious backsheet having two sides, an inner side attached to the absorbent medium and an outer side, the outer side provided with a fastener for attaching the strip to the wearable item;

a peel sheet attached to the backsheet; and a liquid permeable outer sheet having a first side attached to the absorbent medium and a second side making contact with a human body, said outer sheet composed of woven fabric to wick perspiration from the human body to the absorbent medium.

9. The article of claim 8, wherein a strip is cut from the roll.

10. The article of claim 9, wherein the strip is applied to a forehead region of a head covering device.

11. The article of claim 9, wherein the layered strip is applied to an article of clothing.

12. The article of claim 9, wherein the layered strip is applied to an article of sports equipment.

13. The article of claim 9, wherein the strip is rectangular in shape.

14. An absorbent article, comprising:

a roll of perspiration absorbing layered material with a width dimension in the range of approximately one-quarter to at most two inches and a length dimension in the range of approximately one to twenty feet, wherein the layered material contains:

an absorbent medium for absorbing perspiration;

a moisture impervious backsheet having two sides, an inner side attached to the absorbent medium and an outer side provided with a fastener comprising a fibrous material that can attach to a hook fastener strip attached to a wearable item; and a liquid permeable outer sheet having a first side attached to the absorbent medium and a second side making contact with a human body, said outer sheet composed of woven fabric to wick moisture from the human body to the absorbent medium.

15. An absorbent article, comprising:

a stack of rectangular layered strips, wherein the rectangular shaped strips have a width dimension in the range of approximately one-quarter to at most two inches and a length dimension in the range of approximately three to eight inches, wherein each of the rectangular layered strips contains:

an absorbent medium for absorbing moisture;

a moisture impervious backsheet having two sides, an inner side attached to the absorbent medium and an outer side provided with a fastener comprising a fibrous material that can attach to a hook fastener strip;

a peel sheet attached to the backsheet; and a liquid permeable outer sheet having a first side attached to the absorbent medium and a second side making contact with a human body, said outer sheet composed of woven fabric to wick moisture from the human body to the absorbent medium.

16. The article of claim 15, wherein one rectangular layered strip is applied to a forehead region of a head covering device.

17. The article of claim 15, wherein one rectangular layered strip is applied to an article of clothing.

18. The article of claim 15, wherein one rectangular layered strip is applied to an article of sports equipment.

19. An absorbent article, comprising:

a stack of rectangular layered strips, wherein the rectangular shaped strips have a width dimension in the range of approximately one-quarter to at most two inches and a length dimension in the range of approximately three to eight inches, wherein each of the rectangular layered strips contains:

an absorbent medium for absorbing moisture;

a moisture impervious backsheet having two sides, an inner side attached to the absorbent medium and an outer side provided with a fastener comprising a fibrous material that can attach to a hook fastener strip; and a liquid permeable outer sheet having an inner side attached to the absorbent medium and an outer side in contact with a human body, said outer sheet composed of woven fabric to wick the moisture from the human body to the absorbent medium.

20. A method of absorbing perspiration from a person's head, comprising the steps of:

removing a peel layer of an absorbent strip, said absorbent strip comprising:

an absorbent medium for absorbing perspiration;

a moisture impervious backsheet having two sides, an inner side attached to the absorbent medium and an outer side provided with a fastener; and a liquid permeable outer sheet having an inner side attached to the absorbent medium and an outer side in contact with a human body, said outer sheet composed of woven fabric to wick moisture to the absorbent medium; and affixing the absorbent strip to a rim of a head covering device with the fastener.

21. The method of claim 20, wherein the absorbent strip is rectangular in shape.

22. A method of absorbing perspiration from a person's head, comprising the steps of:

affixing a fibrous layer of an absorbent strip to a hook layer of a head covering device, said absorbent strip comprising:

an absorbent medium for absorbing perspiration;

a moisture impervious backsheet having two sides, an inner side attached to the absorbent medium and an outer side provided with a fastener comprising a fibrous material that can attach to a hook fastener strip; and a liquid permeable outer sheet having an inner side attached to the absorbent medium and an outer side in contact with a human body, said outer sheet composed of woven fabric to wick moisture from the human body to the absorbent medium.

23. The method of claim 22, wherein the absorbent strip is rectangular in shape.

24. An article, comprising:

a strip with a width dimension in the range of approximately one-quarter to at most two inches and a length dimension in the range of approximately three to eight inches, the strip having:

an absorbent medium for absorbing moisture;

a liquid impervious backsheet having a first side attached to the absorbent medium, and a second side having a fastener; and liquid permeable outer sheet having an inner side attached to the absorbent medium and an outer side in contact with a human body, said outer sheet composed of woven fabric to wick moisture from the human body to the absorbent medium.

25. The article of claim 24, wherein the strip further has a peel sheet attached to the fastener which includes an adhesive.

26. The article of claim 25, wherein the strip is applied to a head covering device.

27. The article of claim 26, wherein the strip is applied to an article of clothing.

28. The article of claim 26, wherein the strip is applied to an article of sports equipment.

29. The article of claim 25, wherein said fastener is comprised of a fibrous material that can attach to a hook fastener strip.

30. The article of claim 25, wherein the strip is rectangular in shape.

31. The article of claim 25, wherein the absorbent medium is cotton.

* * * * *